United States Patent [19]

Williamson

[11] 4,201,025

[45] May 6, 1980

[54] PREFINISHED VINYL WALL SYSTEM

[76] Inventor: Elliott Williamson, 11915 Quincy La., Dallas, Tex. 75230

[21] Appl. No.: 896,093

[22] Filed: Apr. 13, 1978

Related U.S. Application Data

[63] Continuation-in-part of Ser. No. 824,901, Aug. 15, 1977, abandoned.

[51] Int. Cl.[2] ..... E04B 5/52

[52] U.S. Cl. ..... 52/489; 52/746

[58] Field of Search ..... 52/481, 483, 489, 511, 52/584, 361, 363, 746

[56] References Cited

U.S. PATENT DOCUMENTS

| | | | |
|---|---|---|---|
| 3,732,660 | 5/1973 | Byssing | 52/489 |
| 3,903,671 | 9/1975 | Cuin et al. | 52/480 |
| 3,922,764 | 12/1975 | Downing | 52/489 X |
| 3,965,639 | 6/1976 | Boarini | 52/483 X |
| 3,969,865 | 7/1976 | Andersen | 52/483 |
| 3,998,018 | 12/1976 | Hodges | 52/481 |
| 4,069,640 | 1/1978 | Dawdy | 52/481 X |

FOREIGN PATENT DOCUMENTS

| | | | |
|---|---|---|---|
| 658374 | 10/1951 | United Kingdom | 52/489 |

*Primary Examiner*—J. Karl Bell

*Attorney, Agent, or Firm*—Richards, Harris & Medlock

[57] ABSTRACT

The specification discloses a prefinished vinyl wall system for modular construction in an office building and a method for installing the same. Prefinished wall panels are dimensioned to abut with one another along their lateral edges. The panels are cemented to C-beams located just behind the panels on both sides of the joint. Staples are inserted along the lateral edges of each panel to engage a freely floating T-section disposed behind the joint formed by abutting panels to retain the panels in alignment until such time as the panels are permanently secured to the C-beams. The exterior portion of the lateral edges of each panel are beveled to form a V-junction on the finished side of the panels at the joint to give the panels a professional, workmanlike appearance.

7 Claims, 4 Drawing Figures

PREFINISHED VINYL WALL SYSTEM

RELATED APPLICATIONS

This application is a continuation-in-part of copending Application for United States Letters Patent Ser. No. 824,901, filed Aug. 15, 1977 now abandoned.

BACKGROUND OF THE INVENTION

1. Field of the Invention

This invention relates to elements for constructing modules in office buildings and more particularly to prefinished wall systems and methods for installing the same.

2. Discussion of the Prior Art

In office buildings, it is desirable to construct office modules which have a professional finished appearance as rapidly and economically as possible. One system for constructing modules is disclosed by Hess in U.S. Pat. No. 2,875,866, issued Mar. 3, 1959. The Hess patent teaches wall panels having rearwardly abutting legs on each end. The legs of adjacent panels form a "T" configuration about which a triangular shaped sliding member is disposed when the panels are connected. This type of system is workable where panels are formed of metal and abutting legs can easily be shaped therefrom, but it is not practical for most interior applications because sheetrock or gypsumboard is far more economical and desirable material from which to form the walls of offices.

U.S. Pat. No. 3,958,388, issued to Hawes, May 25, 1976, teaches a more practical system for modular construction. Adjacent wall panels have notches in their lateral edges. A plate having teeth on both sides is compressed against the notch and the backside of the panel. A flange extending from the plate along its length engages a truss member disposed just behind the panel to anchor the panels.

Somewhat similar to the wall system taught by Hawes is the RACO FASTRAK MOVABLE PARTITIONS made by Ragland Mfg. Co. of Houston, Texas. In the Ragland system, gypsumboard panels are snapped onto H-beams with a pronged clip which is embedded into the sides of the wall panels. Unlike the present invention, however, the Ragland system does not permit cementing of the panels away from the joint or the use of a floating T-section to form a finished joint.

Although these wall systems are relatively economical and easy to install, they have the serious disadvantage that panels are easily movable and tend to separate at the joint leaving a shoddy, unprofessional appearance. Although this can be ameliorated somewhat by cementing the panels to the adjacent beams at the joint, it has been found in practice that cementing abutting panels to a beam at panel junctions fails to provide the structural integrity needed to maintain a neat, workmanlike appearance.

Accordingly, a need arises for an economical wall system which can be rapidly installed and which has structural integrity necessary to withstand movement to retain a professional appearance.

SUMMARY OF THE INVENTION

The present invention is directed to an economical system for rapidly constructing office modules. By its construction, the present system provides sufficient structural integrity to retain the professional appearance at the joint between abutting wall panels.

In accordance with the present invention, first and second wall panels are dimensioned to be placed in abutment with one another. A freely floating supporting means is disposed adjacent the joint formed by first and second panels in abutment. A clipping means secures each of the panels to the support means at the joints to temporarily retain the panels in alignment until they are more permanently secured to the building structure. Each panel is then cemented to beams positioned behind the panels some distance from the joint defined by the abutting panels.

DESCRIPTION OF THE DRAWINGS

For a more complete understanding of the present invention and for further objects and advantages thereof, reference is now made to the following description taken in conjunction with the accompanying drawings in which.

DESCRIPTION OF THE PREFERRED EMBODIMENT

Figure 1:
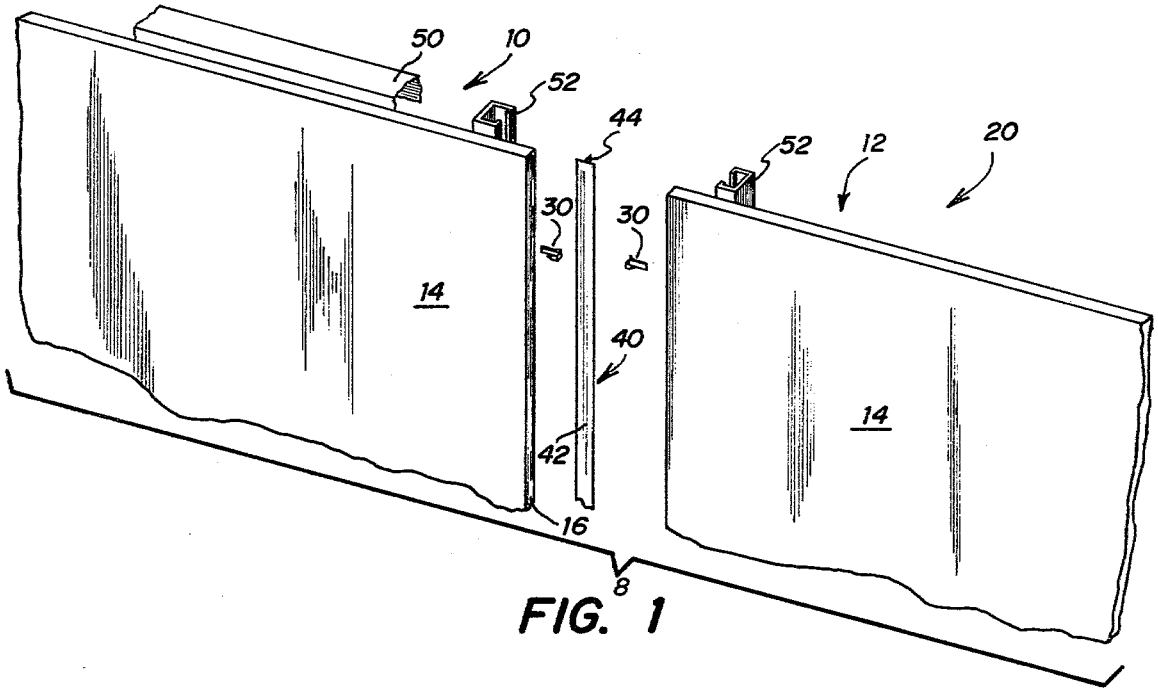
FIG. 1 is an exploded perspective view of the present invention.

Referring to the drawings, there is shown a prefinished wall system designated generally by the numeral 8, which forms the subject of the present invention. Panels 10 and 12 are cut to size to afford maximum handleability and structural integrity. Staples 30 are nailed along the lateral edge 16 of the panels to engage floating T-section 40 when adjacent panels are placed in abutment as hereafter described.

Figure 2:
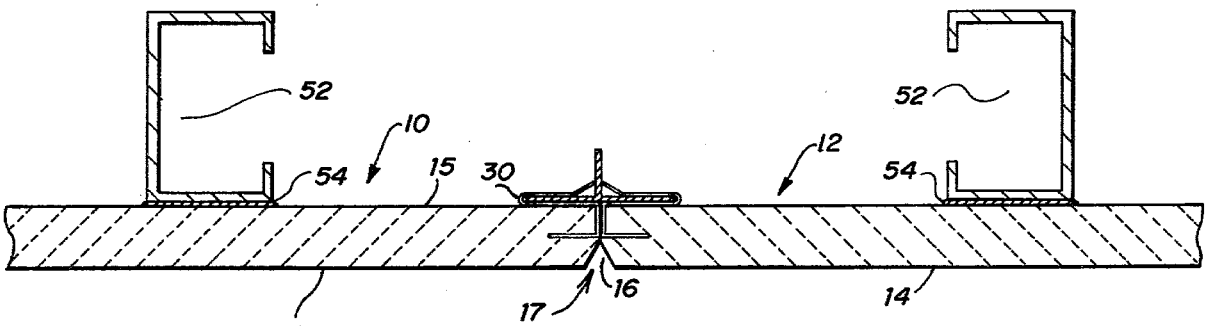
FIG. 2 is a section view of the system assembled.

FIGS. 1 and 2 illustrate the assembly of the prefinished wall system. In the preferred embodiment, a prefinished wall panel 10 is manufactured from sheetrock or gypsumboard, the type used for standard office walls, having a thickness of approximately ⅝ of an inch. While panels of many different sizes are contemplated by the present invention, it has been found in practice that panels approximately 9 feet high by 30 inches wide provide maximum handleability in terms of size and weight for a working crew. The present invention contemplates gypsumboard panels prefinished on the exterior face 14 thereof with vinyl or fiber coating. Prefinished gypsumboard can be purchased and readily cut to required sizes or alternatively, unfinished gypsumboard may be cut and finished in a small press by the installer.

As shown in FIG. 2, the outermost extent of lateral edge 16 of panels 10 and 12, adjacent finished faces 14, are beveled outwardly so that when panels 10 and 12 are placed in abutment, a V-joint 17, formed by the bevels, having a depth of approximately 3/32 inch, extends the length of the panel to give the panel a professional, workmanlike appearance.

Figure 3:
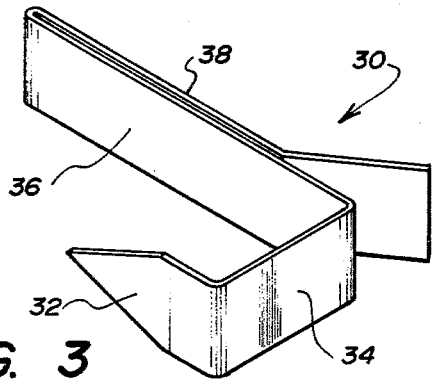
FIG. 3 is a perspective view of the clip.

As shown in FIGS. 1–3, staple 30 is nailed midway into the lateral edge 16 of each pair of panels 10 and 12. As best shown in FIGS. 2 and 3, the head 32 of the staple is designed to be driven into the lateral edge of panels 10 and 12. Head 32 has inclined edges which terminate in a sharp point to facilitate the driving of the staple into the lateral edge 16 of panels 10 and 12. Integral with and approximately perpendicular to head 32 is neck 34 of the staple which is disposed partially along lateral edge 16 when head 32 is driven therein, as shown in FIG. 2. Perpendicular to neck 34 of the staple is body 36 which extends approximately $\frac{5}{8}$ inch in the direction of head 32 along the unfinished side 15 of panels 10 and 12. At the terminus of body 36, staple 30 is bent back upon itself to form clip portion 38. About two-thirds the distance from the terminus of body 36, clip portion 38 is bent outwardly at approximately a 30 degree angle and extends to the plane of neck 34. Clip portion 38 (FIG. 3) is designed to anchor staple 30 to the T-section 40, as shown in FIG. 2; the angularly extending portion of clip portion 38 provides additional support for the staple as it abuts with T-section 40 as hereafter described. In the preferred embodiment, staple 30 is manufactured from steel such as No. 1075 spring steel with a thickness of 0.025 inches and a cross sectional width of 3/16 inch.

Figure 4:
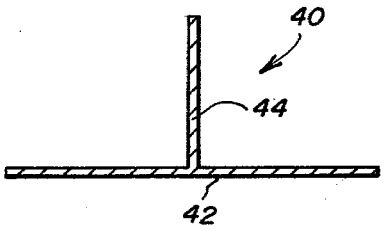
FIG. 4 is a section view of the T-section.

T-section 40 is a lightweight roll formed nonload-bearing electro-galvanized metal member designed for temporary duty in conjunction with staples 30 for maintaining adjacent wall panels in temporary alignment. T-section 40 has a planar face 42 and a perpendicular web 44. T-section 40 extends substantially the length of the joint defined by adjacent panels 10 and 12. Face 42 receives clip portion 38 on each side of the web 44, which extends perpendicular to face 42. Accordingly, face 42 extends approximately $\frac{5}{8}$ inch from the perpendicular web 44 on each side as shown in FIGS. 2 and 4. As best shown in FIG. 2, the clip portion 38 (FIG. 3) of staple 30 angles away from the unfinished side 15 of panels 10 and 12 to abut with web 44, providing structural support for staple 30.

T-section 40 is not anchored or mounted to the wall panels 10 or 12, but is freely suspended, being held only by staples 30 which are driven into the lateral edges 16 of abutting panels. T-section 40 is nonloadbearing and is not attached to the structural supports of the building. Its sole function is to retain adjacent panels in abutment until the construction cement applied elsewhere has had an opportunity to dry. Normally, the construction cement will completely dry in twenty-four hours. After this time, the T-sections could be removed, although in practice it is easiest to leave them, especially when the backside of the panels is no longer accessible.

FIGS. 1 and 2 illustrate the assembly of the wall system which comprises the present invention. Prior to installation, metal tracks 50, shown in FIG. 1, are mounted in parallel relationship on the ceiling and floor of the area in which the modules are to be constructed. Parallel metal tracks 50, which mark the boundaries of the modules, are standard construction equipment and form no part of the present invention. Metal C-beams 52 to which the above-described wall panels are to be cemented are snapped into the tracks in pairs about 6 inches apart. Other structural supports, of course, could also be used. Use of panels 30 inches by 9 feet necessitates placing a pair of C-beams every 30 inches apart. Normally the metal tracks and C-beams are installed prior to installation of the wall panels.

The first step in installing the panels is to drive a series of staples 30 into the lateral edge 16 of panels 10 and 12. Any number of staples may be used, although in practice seven staples equally spaced from one another along the nine foot section edge are adequate to secure the T-section. When the staples have been inserted in lateral edge 16, the panels are stabilized by means of screws disposed along the top and bottom portion of the panel into the ceiling and floor tracks 50. The screw heads that are disposed along the top and bottom portions of the wall panels will be hidden from view by a metal molding disposed along the top and a rubber or wood base molding disposed along the bottom of the walls at a later time.

Once a panel section has been secured to the ceiling and floor tracks, one side of the face 42 of T-section 40 can then be inserted into the clip portions 38 of the staples that have been embedded into the lateral edge of the panel. A second panel section, with staples inserted, is then positioned in abutting relationship with the first panel by sliding the opposite side of face 42 into the staples disposed along the length of the second panel 12. The second panel can then be secured to the upper and lower track by means of screws applied by a screwgun and the first and second panels may then be cemented to the studs by applying a layer of conventional construction cement 54, as shown in FIG. 2. The process is continued until the wall is complete. Inside corners are constructed by placing a panel without the beveled edge at right angles to the finished wall.

The advantage of cementing panels to studs away from the joint is that a single wall panel is cemented to a single stud, rather than two panels to one stud. This not only provides a stronger bond between panels and studs with the increased surface area available for cementing, but permits use of the staples and T-section to further secure the two panels in alignment at their junction. By not cementing panels at the joint, cement is prevented from penetrating the junction, which causes the panels to separate.

Although particular embodiments of the invention have been described herein, it will be understood that the invention is not limited to the embodiments disclosed, but is capable of rearrangement, modification and substitution of parts and elements without departing from the spirit and scope of the invention.

What is claimed is:

1. A method for mounting wall panels to structural supports in an office building to form office modules, comprising the steps of:

inserting clipping means into the abutting edges of first and second prefinished wall panels;

securing adjacent first prefinished wall panels onto ceiling and floor tracks disposed in parallel relation to one another;

guiding a second panel into abutment with said first panel so that clipping means inserted in said second panel engages the freely floating temporary retaining means disposed rearward the joint of the abutting panels; and permanently cementing the rearward side of said first and said second panels away from the edges thereof to studs attached to the building and disposed in said ceiling and in said floor tracks.

2. The method for constructing modules in an office building as defined in claim 1, wherein C-studs are disposed in said ceiling and floor tracks and said studs are spaced on each side of said joint defined by said first and said second panels, approximately three inches from said joint.

3. A prefinished wall system for modular construction in a building whereby wall panels are cemented to the structural supports in a building and structure is provided for maintaining the panels in alignment while the cement is drying, the system comprising:

first wall panels;

second wall panels substantially identical to the first wall panels to be placed in edgewise abutment therewith to form a joint, the joints being formed distally of the structural supports;

cementing means applied to the rearward side of said first and second panels distally of the joint for cementing the panels to the structural supports connected to the building;

nonloadbearing retaining means disposed rearward the joints formed by abutting panels for maintaining adjacent panels in abutment until cementing means applied thereto has dried and the panels are permanently secured to the structural supports; and clipping means disposed along the abutting edges of said first and second panels for securing each of said panels to the retaining means.

4. The prefinished wall system as defined in claim 3, wherein the exterior portion of the lateral edges of said first and said second panels are beveled outwardly to define a wedge-shaped groove at the joint between said first and said second panels when said panels are in abutment.

5. The prefinished wall system in claim 3 wherein said first and second panels are gypsumboard, prefinished with vinyl.

6. The prefinished wall system as defined in claim 3 wherein said temporary retaining means is a T-section having a face for receiving said clipping means and a web substantially perpendicular to said face for anchoring said clipping means.

7. In a system for modular construction in a building whereby wall panels are cemented to the structural supports in a building and structure is provided for maintaining the panels in alignment while the cement is drying, the system comprising:

first prefinished wall panels;

second prefinished wall panels substantially identical to said first panels, each of said second panels adapted to abut with one of said first panels, said first and said second panels having the exterior portion of their lateral edges beveled outwardly to define a wedge-shaped groove on the finished surface thereof at the joint between each of said first and said second panels when said first and said second panels are in abutment;

said first and second wall panels manufactured of gypsumboard, prefinished on the exterior side thereof with vinyl;

cementing means applied to the rearward side of said first and second panels away from the edges thereof for cementing the panels to the supporting structure connected to the building;

a nonstructural, nonloadbearing T-section disposed rearward the joint formed between adjacent first and said second panels for temporarily retaining said panels in abutment until cementing means applied thereto has dried and the panels are permanently secured to the structural supports, said T-section having a face portion for receiving the clipping means disposed in each of said first and said second panels and also having a web portion extending substantially perpendicular to said face portion, said T-section being substantially the length of the joint defined by said first and said second panels; and clipping means for securing each of said first and said second panels to the face portion of said T-section, each of said clipping means having a pointed head, a neck substantially perpendicular thereto, said neck having length less than the width of the lateral edge of said first and said second panels, said clipping means having a body perpendicular to said neck and a clip portion biased toward said body, said clipping means dimensioned to receive the face portion of said T-section between said body and said clip portion.

* * * * *